US008526861B2

(12) United States Patent
Matsumoto

(10) Patent No.: US 8,526,861 B2
(45) Date of Patent: Sep. 3, 2013

(54) IMAGE FORMING APPARATUS

(75) Inventor: Takuji Matsumoto, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 184 days.

(21) Appl. No.: 13/279,622

(22) Filed: Oct. 24, 2011

(65) Prior Publication Data

US 2012/0251167 A1 Oct. 4, 2012

(30) Foreign Application Priority Data

Mar. 28, 2011 (JP) ..... 2011-071130

(51) Int. Cl.
*G03G 21/16* (2006.01)
*G03G 15/04* (2006.01)
*G03G 15/08* (2006.01)

(52) U.S. Cl.
USPC ..... 399/258; 399/111; 399/119; 399/254

(58) Field of Classification Search
USPC ..... 399/111, 119, 254, 258
See application file for complete search history.

(56) References Cited

U.S. PATENT DOCUMENTS 5,142,325 A * 8/1992 Kai et al. ..... 399/41
5,311,260 A * 5/1994 Nakakuma et al. ..... 399/226
7,809,322 B2 * 10/2010 Takeuchi et al. ..... 399/359
7,831,175 B2 * 11/2010 Moon et al. ..... 399/119
8,073,366 B2 * 12/2011 Moon et al. ..... 399/258
2002/0181968 A1 * 12/2002 Okimura et al. ..... 399/111
2008/0260431 A1 * 10/2008 Saito ..... 399/256
2010/0092216 A1 * 4/2010 Spence et al. ..... 399/258
2011/0150526 A1 * 6/2011 Sasaki et al. ..... 399/111
2011/0222914 A1 * 9/2011 Yoshihara ..... 399/258

FOREIGN PATENT DOCUMENTS

JP A-2010-117658 5/2010

* cited by examiner

*Primary Examiner* — David Gray
*Assistant Examiner* — G. M. Hyder
(74) *Attorney, Agent, or Firm* — Oliff & Berridge, PLC

(57) ABSTRACT

An image forming apparatus includes image forming units which are detachably mounted on an apparatus body, and each of which includes an image holding body and a developing unit provided with a developing member that supplies a developer to the electrostatic latent image formed on the surface of the image holding body, shaft members which rotatably support the developing units, urging members which urge the developing members toward the image holding bodies, supply devices which supply developers to the developing units, transport passages which are provided so as to extend toward the developing members and the image holding bodies, and elastic members which form a part of the transport passage and are extensibly deformed so as to absorb the deviation of the relative position between the supply port and the receiving port.

12 Claims, 9 Drawing Sheets

IMAGE FORMING APPARATUS

CROSS-REFERENCE TO RELATED APPLICATIONS

This application is based on and claims priority under 35 USC 119 from Japanese Patent Application No. 2011-071130 filed Mar. 28, 2011.

BACKGROUND

Technical Field

The present invention relates to an image forming apparatus.

SUMMARY

According to an aspect of the invention, there is provided an image forming apparatus including: image forming units that are detachably mounted on an apparatus body, each of the image forming units including an image holding body where an electrostatic latent image is formed on a surface of the image holding body and a developing unit provided with a developing member that is disposed with a gap between the developing member and the image holding body and supplies a developer to the electrostatic latent image formed on the surface of the image holding body while rotating; shaft members that are provided at the image forming units and rotatably support the developing units so that the developing members approach or are separated from the image holding bodies when seen in a direction of a rotation axis of the developing member, a direction of a rotation axis of each shaft member being parallel to the rotation axis of the developing member; urging members that are provided at the image forming units and urge the developing members toward the image holding bodies, one end of each of the urging members being fixed to each of the developing units; supply devices that are disposed adjacent to the developing units and supply developers to the developing units when seen in the direction of the rotation axis of the developing member; transport passages of which base end portions are connected to body parts of the supply devices, through which developers stored in the body parts are transported to the developing units, and which are provided so as to extend toward the developing members and the image holding bodies when seen in the direction of the rotation axis of the developing member, the developers being transported to the developing units from supply ports formed at leading end portions of the transport passages through receiving ports of the developing units connected to the supply ports; and elastic members each of which forms a part of the transport passage and is extensibly deformed so as to absorb the deviation of the relative position between the supply port and the receiving port.

BRIEF DESCRIPTION OF THE DRAWINGS

Exemplary embodiments of the present invention will be described in detail based on the following figures, wherein.

DETAILED DESCRIPTION

Figure 1:
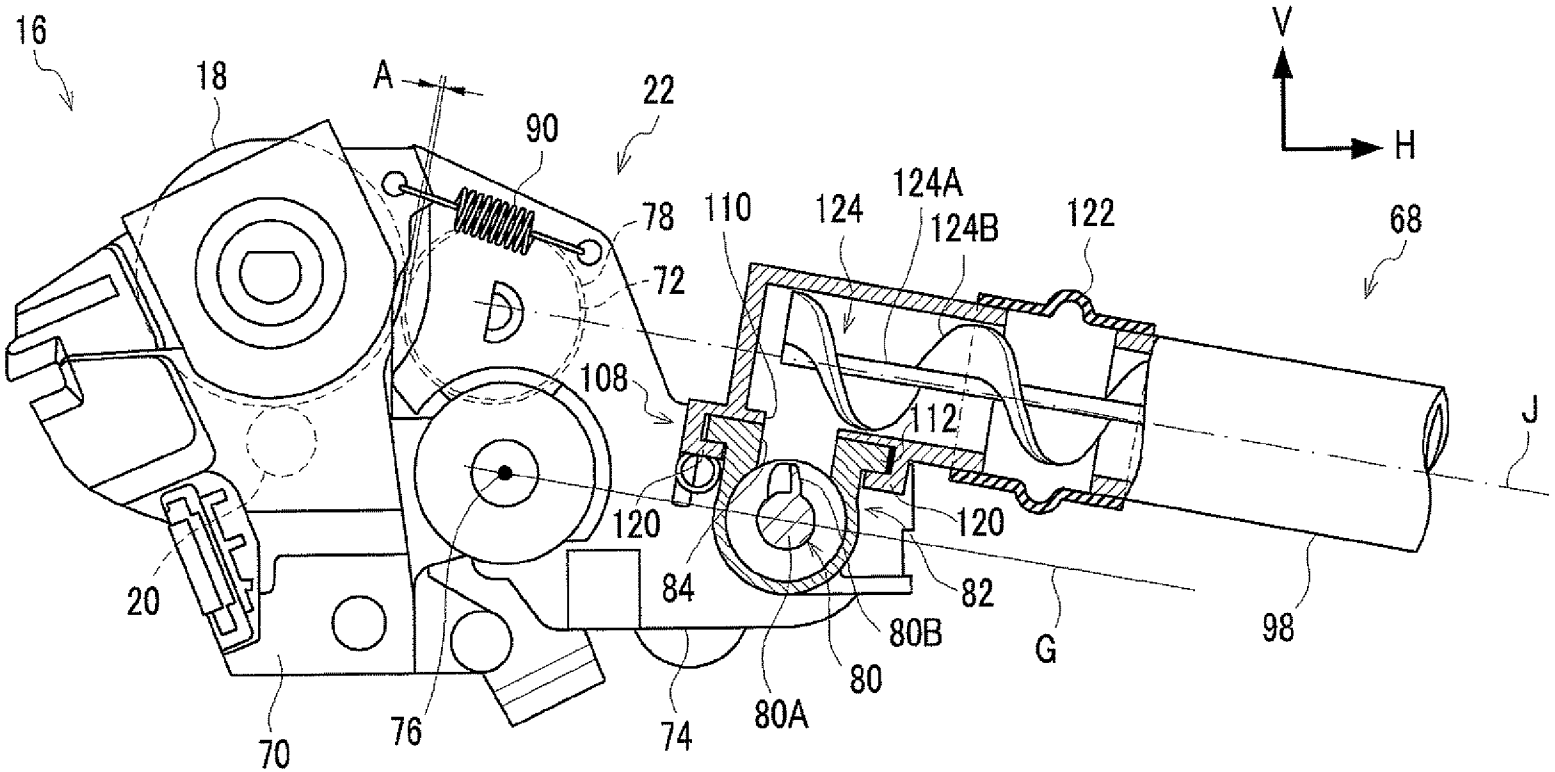
FIG. 1 is a side view of an image forming unit and the like used in an image forming apparatus according to an exemplary embodiment of the invention.

An example of an image forming apparatus according to an exemplary embodiment of the invention will be described with reference to FIGS. 1 to 8. Meanwhile, an arrow V shown in the drawings shows a vertical direction and an arrow H shows a horizontal direction.

(Entire Configuration)

Figure 8:
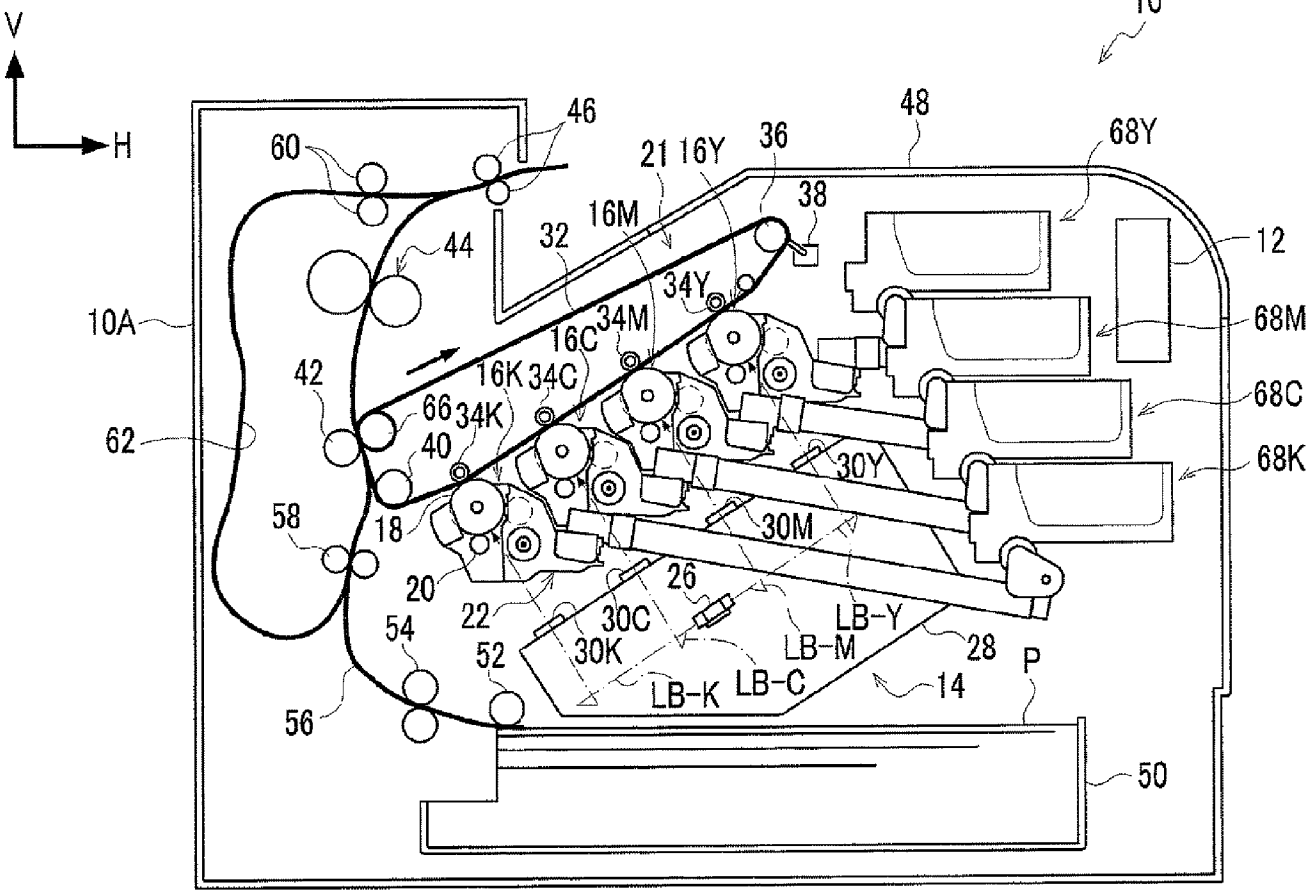
FIG. 8 is a schematic configurational diagram of the image forming apparatus according to the exemplary embodiment of the invention.

A view of an image forming apparatus 10, which is seen from the back surface (the surface opposite to the surface corresponding to a user operating the apparatus), is shown in FIG. 8. As shown in FIG. 8, an image processing unit 12, which performs the image processing of image data to be input, is provided in an apparatus body 10A of the image forming apparatus 10.

The image processing unit 12 processes input image data into gray scale data corresponding to four colors, that is, yellow (Y), magenta (M), cyan (C), and black (K). An exposure device 14, which receives the processed gray scale data and performs image exposure using laser beams LB, is provided at the central portion in the apparatus body 10A.

Further, four image forming units 16Y, 16M, 16C, and 16K corresponding to yellow (Y), magenta (M), cyan (C), and black (K) are disposed above the exposure device 14 at intervals in the direction inclined to the horizontal direction, and are detachably mounted on the apparatus body 10A. Meanwhile, when Y, M, C, and K do not need to be distinguished from each other in the description, reference letters Y, M, C, and K may be omitted.

All of these four image forming units 16Y, 16M, 16C, and 16K have the same configuration. Each of the image forming units includes a columnar image holding body 18, a charging member 20 for primary charging, a developing unit 22, and a cleaning blade (not shown). The columnar image holding body is rotationally driven at a predetermined speed. The charging member 20 for primary charging charges the outer peripheral surface of the image holding body 18. The developing unit 22 visualizes an electrostatic latent image, which is formed on the charged outer peripheral surface of the image holding body 18, as a toner image by developing the electrostatic latent image with a predetermined color toner through the image exposure of the above-mentioned exposure device 14. The cleaning blade cleans the outer peripheral surface of the image holding body 18.

Moreover, toner supply devices 68, which supply toners to the developing units 22, are provided on the right side of the developing units 22 in the horizontal direction shown in FIG. 8 so as to be adjacent to the developing units 22. Meanwhile, the image forming units 16 and the toner supply devices 68 will be described in detail below.

Further, the exposure device 14 is provided with four semiconductor lasers (not shown) that have the configuration common to the four image forming units 16Y, 16M, 16C, and 16K. Laser beams LB-Y, LB-M, LB-C, and LB-K are emitted from these semiconductor lasers in accordance with gray scale data.

Meanwhile, the laser beams LB-Y, LB-M, LB-C, and LB-K emitted from the semiconductor lasers are radiated to a polygon mirror 26, which is a rotating polygon mirror, through a cylindrical lens (not shown) and are deflected and scanned by the polygon mirror 26. Further, the laser beams LB-Y, LB-M, LB-C, and LB-K, which are deflected and scanned by the polygon mirror 26, are scanned and exposed obliquely from below to exposure points on the image holding bodies 18 through an imaging lens and plural mirrors (not shown).

Furthermore, since the exposure device 14 scans and exposes images on the image holding bodies 18 from below, there is a concern that toners and the like fall onto the exposure device 14 from the developing units 22 and the like of the four image forming units 16Y, 16M, 16C, and 16K positioned on the upper side. For this reason, the periphery of the exposure device 14 is sealed by a rectangular parallelepiped frame 28. Moreover, windows 30Y, 30M, 30C, and 30K, which are made of transparent glass and transmit four laser beams LB-Y, LB-M LB-C, and LB-K toward the image holding bodies 18 of the respective image forming units 16Y, 16M, 16C, and 16K, are provided on the upper portion of the frame 28.

Meanwhile, a primary transfer unit 21 as an example of a transfer device is provided above the respective image forming units 16Y, 16M, 16C, and 16K. Further, the primary transfer unit 21 includes an intermediate transfer belt 32 as an example of an endless member; a driving roll 36 where the intermediate transfer belt 32 is wound and which is rotationally driven and revolves the intermediate transfer belt 32 in the direction of an arrow; a tensioning roll 40 as an example of a tensioning member where the intermediate transfer belt 32 is wound and which applies tension to the intermediate transfer belt 32; a driven roll 66 that is provided above the tensioning roll 40 and rotationally driven together with the intermediate transfer belt 32; and primary transfer rolls 34Y, 34M, 34C, and 34K as an example of transfer members that are disposed on one side of the intermediate transfer belt 32 opposite to the image holding bodies 18Y, 18M, 18C, and 18K with the intermediate transfer belt 32 interposed therebetween.

Furthermore, the respective color toner images, which correspond to yellow (Y), magenta (M), cyan (C), and black (K) and are sequentially formed on the image holding bodies 18 of the image forming units 16Y, 16M, 16C, and 16K, are multiply transferred to the intermediate transfer belt 32 by the four primary transfer rolls 34Y, 34M, 34C, and 34K.

In addition, a cleaning blade 38, which cleans the outer peripheral surface of the intermediate transfer belt 32, is provided on one side of the intermediate transfer belt 32 opposite to the driving roll 36 with the intermediate transfer belt 32 interposed therebetween.

Further, a secondary transfer roll 42 is provided on one side of the intermediate transfer belt 32 opposite to the driven roll 66 with the intermediate transfer belt 32 interposed therebetween. The respective color toner images, which correspond to yellow (Y), magenta (M), cyan (C), and black (K) and are multiply transferred to the intermediate transfer belt 32, are transported by the intermediate transfer belt 32, are interposed between the driven roll 66 and the secondary transfer roll 42, and are secondarily transferred to a sheet member P as a recording medium to be transported along a sheet transport path 56.

Furthermore, a fixing device 44, which fixes the toner images transferred to the sheet member P to the sheet member P by heat and pressure, is provided on the downstream side of the secondary transfer roll 42 in the transport direction of the sheet member P (hereinafter, simply referred to as the downstream side).

Moreover, discharge rolls 46, which discharge the sheet member P to which the toner images have been fixed to a discharge section 48 provided at the upper portion of the apparatus body 10A of the image forming apparatus 10, are provided on the downstream side of the fixing device 44.

Meanwhile, a sheet feeding member 50 in which sheet members P are stacked is provided on the lower side in the apparatus body 10A of the image forming apparatus 10. In addition, a sheet feeding roll 52, which feeds the sheet members P stacked in the sheet feeding member 50 to the sheet transport path 56, is provided and a separation roll 54, which separates and transports the sheet members P one by one, is provided on the downstream side of the sheet feeding roll 52. Further, a positioning roll 58, which adjusts a transport timing, is provided on the downstream side of the separation roll 54. Accordingly, a sheet member P supplied from the sheet feeding member 50 is fed to a position (secondary transfer position), where the intermediate transfer belt 32 and the secondary transfer roll 42 come into contact with each other, at a predetermined timing by the rotating positioning roll 58.

Furthermore, transport rolls 60, which do not discharge a sheet member P where toner images have been fixed to one surface by the fixing device 44 onto the discharge section 48 by the discharge rolls 46 as it is and transport the sheet member to a sheet transport path 62 for double-sided printing, are provided near the discharge rolls 46. Accordingly, the sheet member P, which is transported along the sheet transport path 62 for double-sided printing, is transported to the positioning roll 58 again while having been inverted. This time, toner images are transferred and fixed to the back of the sheet member P and the sheet member P is then discharged onto the discharge section 48.

An image is formed on the sheet member P as described below due to this configuration.

First, gray scale data corresponding to the respective colors are sequentially output to the exposure device 14 from the image processing unit 12, and laser beams LB-Y, LB-M, LB-C, and LB-K, which are emitted from the exposure device 14 in accordance with the gray scale data, are scanned and exposed to the outer peripheral surfaces of the image holding bodies that are charged by the charging members 20, so that electrostatic latent images are formed on the outer peripheral surfaces of the image holding bodies 18. The electrostatic latent images formed on the image holding bodies 18 are visualized as the respective color toner images, which correspond to yellow (Y), magenta (M), cyan (C), and black (K), by the developing units 22Y, 22M, 22C, and 22K, respectively.

Moreover, the respective color toner images, which correspond to yellow (Y), magenta (M), cyan (C), and black (K) and are formed on the image holding bodies 18, are multiply transferred to the revolving intermediate transfer belt 32 by the primary transfer rolls 34 of the primary transfer unit 21 that are disposed over the respective image forming units 16Y, 16M, 16C, and 16K.

Further, the respective color toner images, which have been multiply transferred to the revolving intermediate transfer belt 32, are secondarily transferred to the sheet member P, which is transported to the sheet transport path 56 from the sheet feeding member 50 at a predetermined timing by the sheet feeding roll 52, the separation roll 54, and the positioning roll 58, by the secondary transfer roll 42.

Furthermore, the sheet member P to which the toner images have been transferred is transported to the fixing device 44. The toner images transferred to the sheet member P are fixed to the sheet member P by the fixing device 44. After the toner images are fixed to the sheet member, the sheet member P is discharged onto the discharge section 48, which is provided at the upper portion of the apparatus body 10A of the image forming apparatus 10, by the discharge rolls 46.

Meanwhile, when images are to be formed on both surfaces of a sheet member P, a sheet member P, where toner images have been fixed to one surface by the fixing device 44, is transported to the sheet transport path 62 for double-sided printing through the transport rolls 60 after the switching of the transport direction of the sheet member without being discharged onto the discharge section 48 as it is by the discharge rolls 46. Further, the sheet member P is transported along the sheet transport path 62 for double-sided printing, so that the sheet member P is inverted. Then, the sheet member P is transported to the positioning roll 58 again. This time, the sheet member P is discharged onto the discharge section 48 by the discharge rolls 46 after toner images are transferred and fixed to the back of the sheet member P.

(Configuration of Main Parts)

Next, the image forming units 16 and the toner supply devices 68 will be described.

As shown in FIG. 1, each of the image forming units 16, which are detachably mounted on the apparatus body 10A (see FIG. 8), is provided with an image holding body housing 70 where the columnar image holding body 18 is rotatably supported and the above-mentioned developing unit 22.

Further, the developing unit 22 is provided with a developing roller 72 as an example of a columnar developing member that is disposed with a gap (A shown in FIG. 1) between itself and the image holding body 18 and supplies a toner to the electrostatic latent image formed on the surface of the image holding body 18 while rotating.

In detail, a developer unit housing 74 where the developing roller 72 is rotatably supported is provided, and the direction of the rotation axis of the developing roller 72 (hereinafter, simply referred to as the direction of the rotation axis) is parallel to the direction of the rotation axis of the image holding body 18.

In addition, the image holding body housing 70 and the developer unit housing 74 are attached to each other by a shaft member 76, of which the axis extends along the direction of the rotation axis of the developing roller 72, so as to rotate relative to each other. Meanwhile, when the image forming unit 16 is mounted on the apparatus body 10A, the image holding body housing 70 is fixed to the apparatus body 10A and the developing unit 22 is supported so as to be rotatable relative to the image holding body housing 70.

Further, cylindrical roller members 78, which have a diameter larger than the diameter of the developing roller 72, are provided at both end portions of the developing roller 72 in the direction of the rotation axis. Furthermore, there are provided springs 90 that urge the roller members 78 so that the roller members 78 come into contact with both end portions of the image holding body 18. The springs 90 are provided at both ends of the developing roller 72 in the direction of the rotation axis. One end of each spring 90 is fixed to the image holding body housing 70 and the other end of each spring 90 is fixed to the developer unit housing 74.

The outer peripheral surfaces of the roller members 78 come into contact with both end portions of the image holding body 18 due to this configuration, so that a predetermined gap (A shown in FIG. 1) is formed between the outer surface of the image holding body 18 and the outer surface of the developing roller 72.

Further, an agitating member 80, which agitates the toner supplied to the developing unit 22 from the toner supply device 68 while rotating and of which the axial direction of a rotating shaft 80A is parallel to the direction of the rotation axis of the developing roller 72, is provided on the right side of the shaft member 76 in the horizontal direction shown in FIG. 1. Specifically, a spiral blade portion BOB is formed on the periphery of the rotating shaft 80A, and the toner is agitated by the rotation of the blade portion 80B.

Furthermore, a receiving port 84, through which the toner supplied from the toner supply device 68 is fed into the developer unit housing 74, is formed at the developer unit housing 74 above the agitating member 80 in the vertical direction and near one end portion of the agitating member 80 in the direction of the rotation axis. Specifically, the receiving port 84 is formed at a mounting portion 82 of the developer unit housing 74 that is mounted on a mounting object portion 108 to be described below (see FIG. 3).

As described above, the shaft member 76 is disposed below the developing roller 72 and the receiving port 84 is disposed parallel to the shaft member 76 in the horizontal direction.

Figure 3:
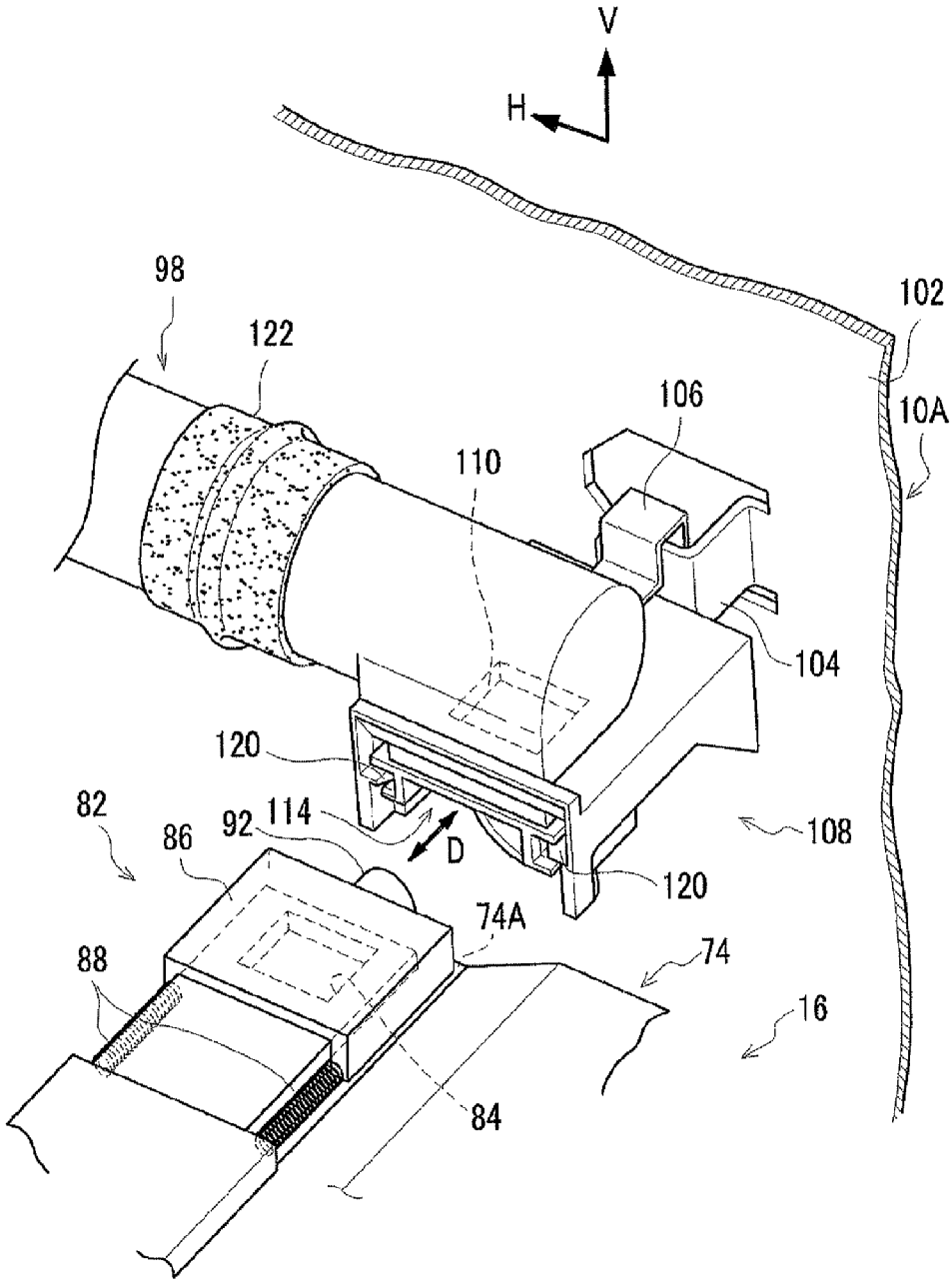
FIG. 3 is an enlarged perspective view of a leading end portion of a toner transport passage of a toner supply device used in the image forming apparatus according to the exemplary embodiment of the invention.

Further, a shutter 86, which closes the receiving port 84 formed at the developer unit housing 74 when the image forming unit 16 is separated from the apparatus body 10A as shown in FIG. 3, is slidably provided.

In detail, the shutter 86 is adapted to be slidable relative to the developer unit housing 74 in the attachment/detachment direction of the image forming unit 16 (which is the depth direction of the apparatus body 10A and is the direction of an arrow D shown in FIG. 3), and is adapted to move between an open position (see FIG. 5C) where the receiving port 84 is opened and a closed position (see FIG. 5A) where the receiving port 84 is closed.

In addition, springs 88, which urge the shutter 86 to the closed position, are provided between the shutter 86 and the developer unit housing 74. Meanwhile, two springs 88 are provided so as to urge the both end portions of the shutter 86 in the horizontal direction.

Further, a protruding portion 92, which comes into contact with a columnar portion 118 (see FIGS. 5A to 5C) of a toner transport passage 98 to be described below when the image forming unit 16 is mounted on the apparatus body 10A, is formed on the outer surface of the developer unit housing 74. Specifically, the protruding portion 92 is formed so as to protrude from a back wall 74A of the developer unit housing 74, which faces the back surface of the apparatus body 10A, in the above-mentioned attachment/detachment direction.

Figure 6:
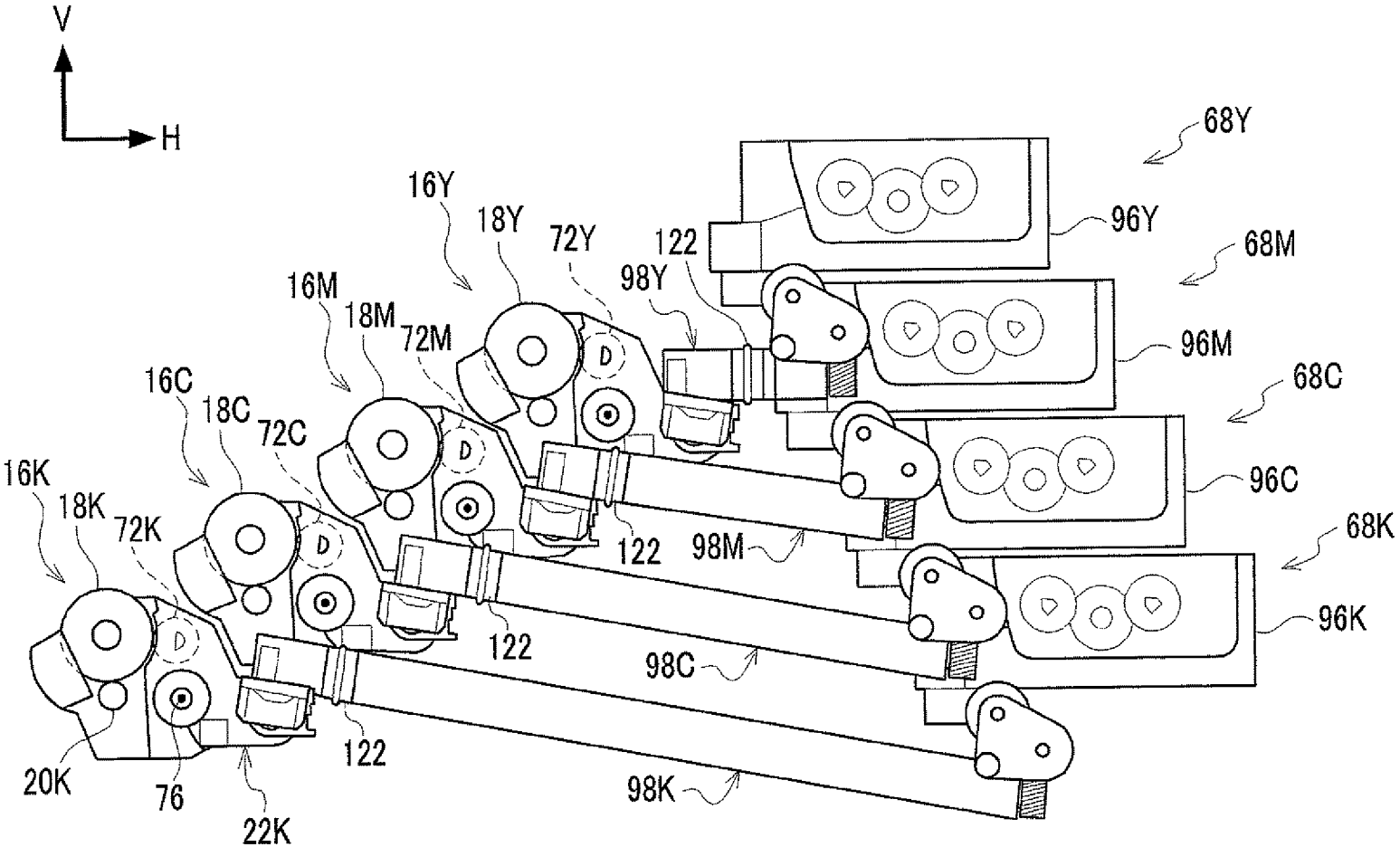
FIG. 6 is a side view showing the image forming units and the toner supply devices used in the image forming apparatus according to the exemplary embodiment of the invention.

Meanwhile, as shown in FIG. 6, the toner supply devices 68, which correspond to the respective colors and supply toners to the developing units 22 corresponding to the respective colors, are provided on the right side of the image forming units 16, which correspond to the respective colors, in the horizontal direction shown in FIG. 6.

Each of the toner supply devices 68 includes a body part 96 in which a toner is stored, and a toner transport passage 98 as a tubular member which is provided so as to extend from the lower surface of the body part 96 toward the developing unit 22 and through which the toner stored in the body part 96 is transported to the developing unit 22. Further, when seen in the direction of the rotation axis of the developing roller 72, as shown in FIGS. 1 and 6, the toner transport passages 98M, 98C, and 98K except for the toner transport passage corresponding to yellow (Y) extend along a straight line G that connects the rotation axis of the shaft member 76 with the rotating shaft 80A of the agitating member 80. That is, when seen in the direction of the rotation axis of the developing roller 72, the straight line G is parallel to the center lines J of each of the toner transport passages 98M, 98C, and 98K.

Moreover, the leading end portion of each of the toner transport passages 98 extends toward the developing roller 72 and the image holding body 18. In addition, when seen in the direction of the rotation axis of the developing roller 72, a spring 90 is provided on one side of the center line J opposite to the shaft member 76 with the center line J of the toner transport passage 98, which extends in the extending direction of the toner transport passage 98, interposed therebetween.

Figure 2:
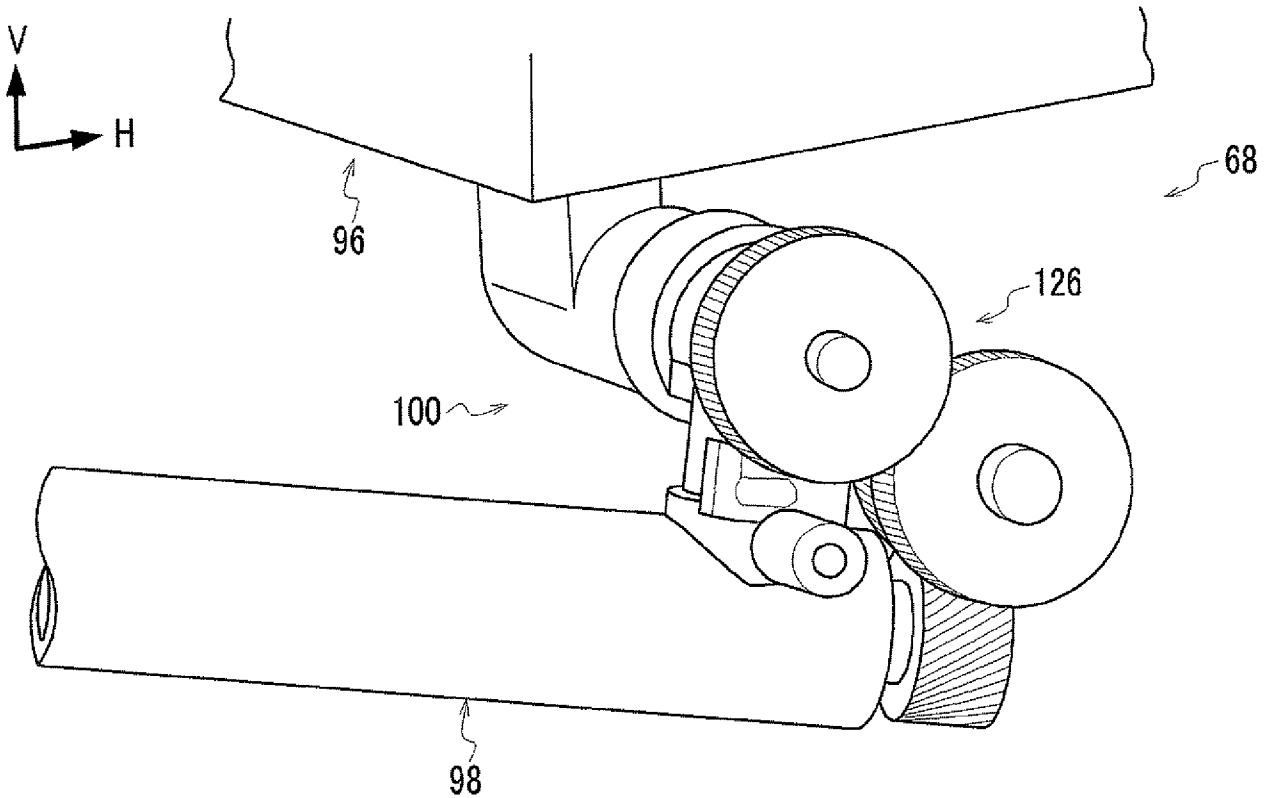
FIG. 2 is an enlarged perspective view of a toner supply device used in the image forming apparatus according to the exemplary embodiment of the invention.

Meanwhile, as shown in FIG. 2, an intermediate passage 100, of which the base end portion is fixed to the lower surface of the body part 96 and the leading end portion is fixed to the base end portion of the toner transport passage 98, is provided on the lower surface of the body part 96. Further, the toner stored in the body part 96 is transported to the base end portion of the toner transport passage 98 through the inside of the intermediate passage 100.

Figure 4:
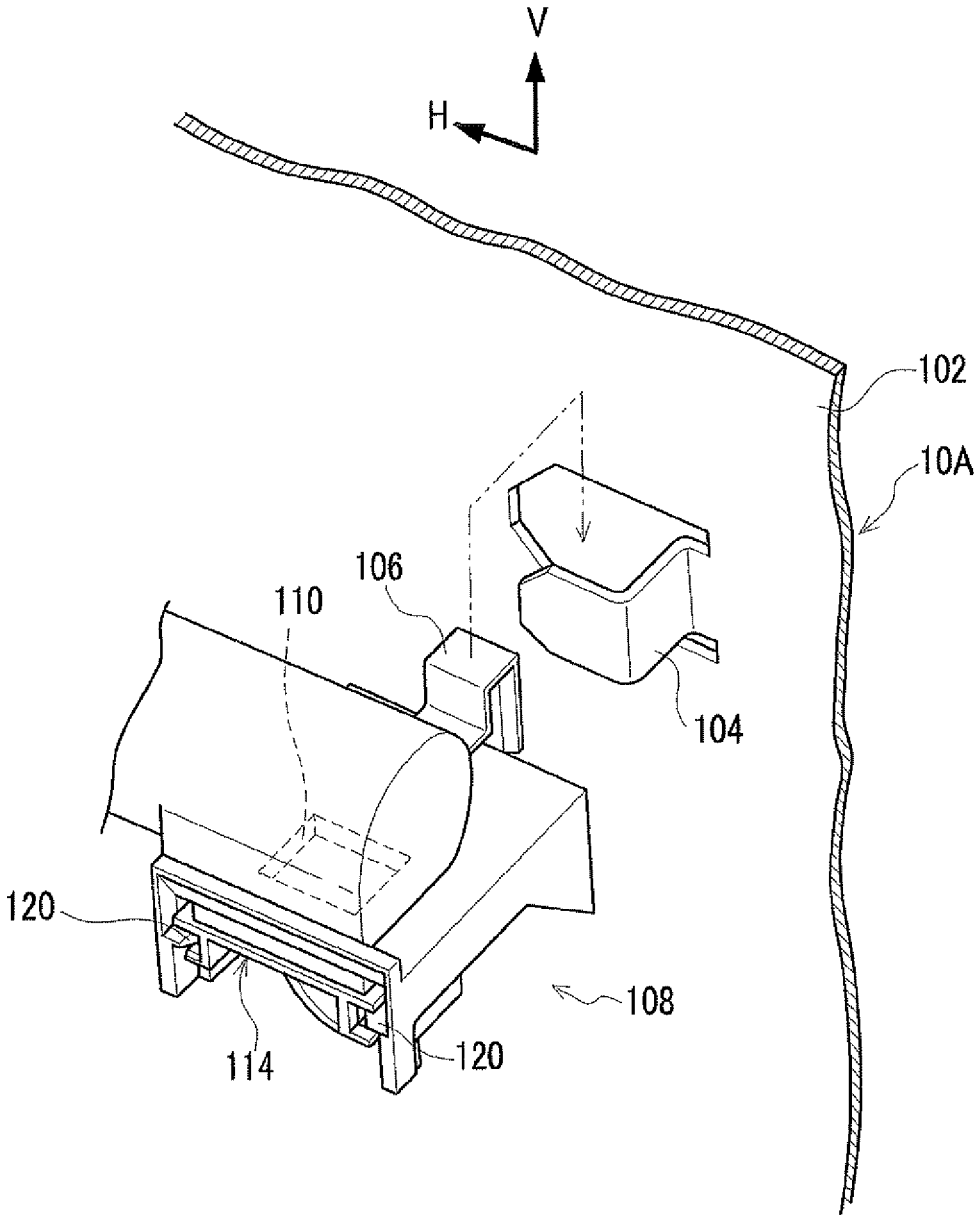
FIG. 4 is an enlarged perspective view of the leading end portion of the toner transport passage of the toner supply device used in the image forming apparatus according to the exemplary embodiment of the invention.

Furthermore, as shown in FIG. 4, a crank-shaped holding portion 104, which is formed by cutting and raising a back panel 102 inward, is formed on the back panel 102 of the apparatus body 10A. In addition, an inverted U-shaped hook portion 106, which is caught by the holding portion 104 from above, is formed at the leading end portion of the toner transport passage 98 facing the back panel 102 of the apparatus body 10A. The hook portion 106 is caught by the holding portion 104 due to this configuration, so that the leading end portion of the toner transport passage 98 is temporarily held on the apparatus body 10A.

Further, a supply port 110 is formed at the lower portion of the leading end portion of the toner transport passage 98 in the vertical direction. A toner is supplied to the developing unit 22 through the supply port 110 and the receiving port 84 that is formed at the mounting portion 82 of the developer unit housing 74.

Furthermore, as shown in FIGS. 3 and 4, a mounting object portion 108 is provided at the lower portion of the supply port 110 in the vertical direction. When the image forming unit 16 is moved in the direction of the arrow D and mounted on the apparatus body 10A, the mounting portion 82 formed at the developer unit housing 74 is mounted on the mounting object portion 108.

In detail, a holding portion 120, which holds a flange portion 112 (see FIG. 1) formed at the mounting portion 82 from below, is formed at the mounting object portion 108. In addition, a shutter 114, which closes the supply port 110 when the image forming unit 16 is separated from the apparatus body 10A, is slidably provided at the holding portion.

The shutter 114 is adapted to be slidable relative to the toner transport passage 98 in the attachment/detachment direction of the image forming unit 16 (which is the depth direction of the apparatus body 10A and is the direction of the arrow D shown in FIG. 3), and is adapted to move between an open position (see FIG. 5C) where the supply port 110 is opened and a closed position (see FIG. 5A) where the supply port 110 is closed.

Figure 5A:
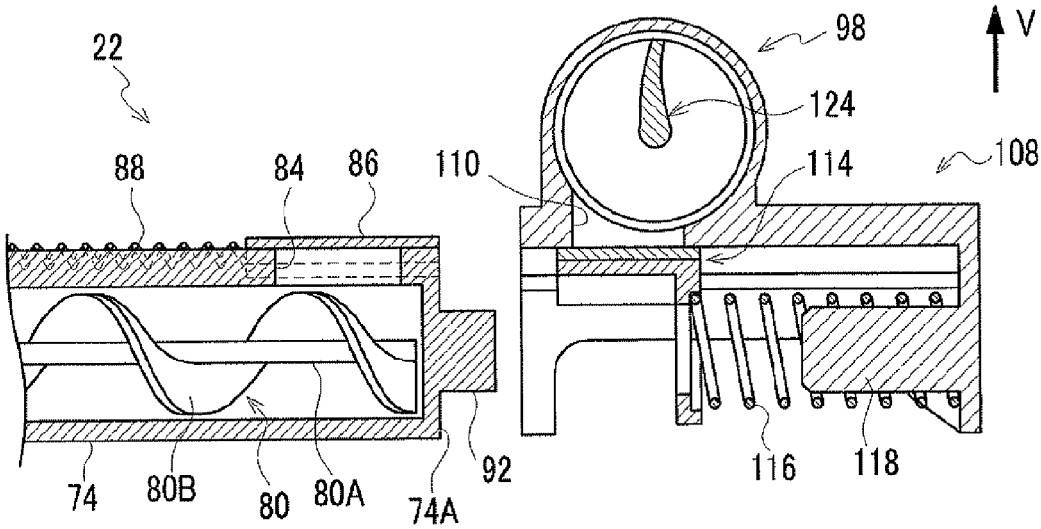
FIGS. 5A, 5B, and 5C are cross-sectional views showing a mounting portion of a developing unit used in the image forming apparatus according to the exemplary embodiment of the invention and a mounting object portion of the toner transport passage.

Moreover, as shown in FIG. 5A, the mounting object portion 108 is provided with a coil-like spring 116 that urges the shutter 114 at the closed position. Further, a columnar portion 118, which supports the spring 116 from the inside, is provided at the mounting object portion 108.

Figure 5B:
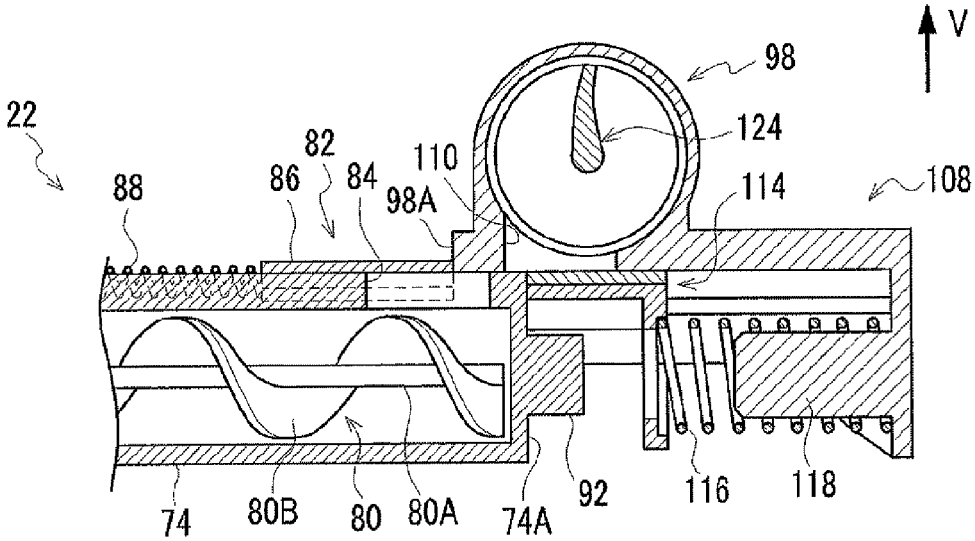
Figure 5C:
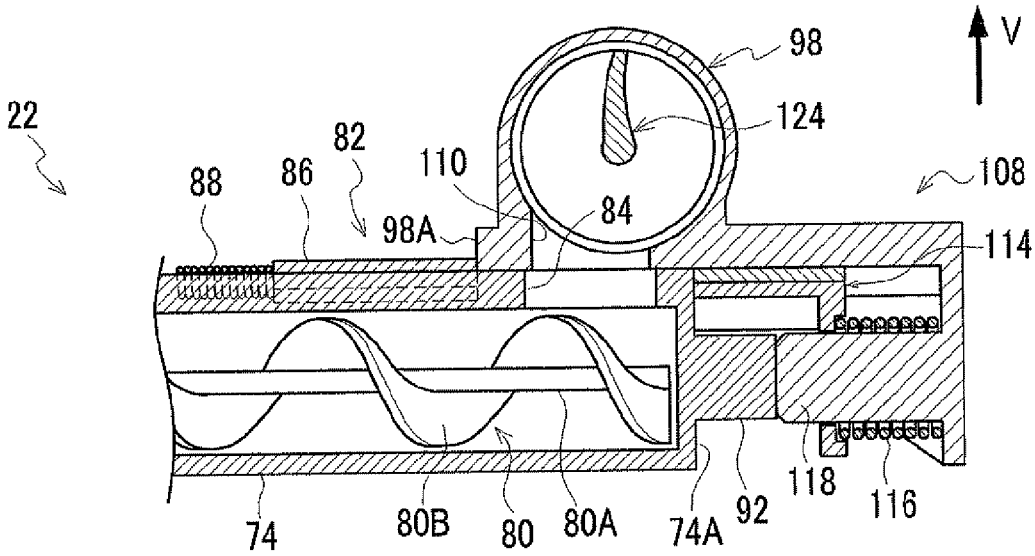

When the mounting portion 82 of the developer unit housing 74 is mounted on the mounting object portion 108 of the toner transport passage 98, the columnar portion 118 comes into contact with the protruding portion 92 of the developer unit housing 74 and the receiving port 84 faces the supply port 110 due to this configuration as shown in FIGS. 5A, 5B, and 5C. Further, in this state, the shutter 114 is pressed against the back wall 74A of the developer unit housing 74 and moved to the open position from the closed position, and the shutter 86 is pressed against a side wall 98A formed at the toner transport passage 98 and moved to the open position from the closed position.

Furthermore, as shown in FIG. 6, a bellows-like rubber tube 122 as an example of an elastic member, which is made of an elastic material, is provided at a portion of each toner transport passage 98 that is closer to the base end portion than the mounting object portion 108. When the relative position between the receiving port 84 and the supply port 110 is deviated, the rubber tube 122 is deformed and absorbs the deviation of the relative position.

Figure 7:
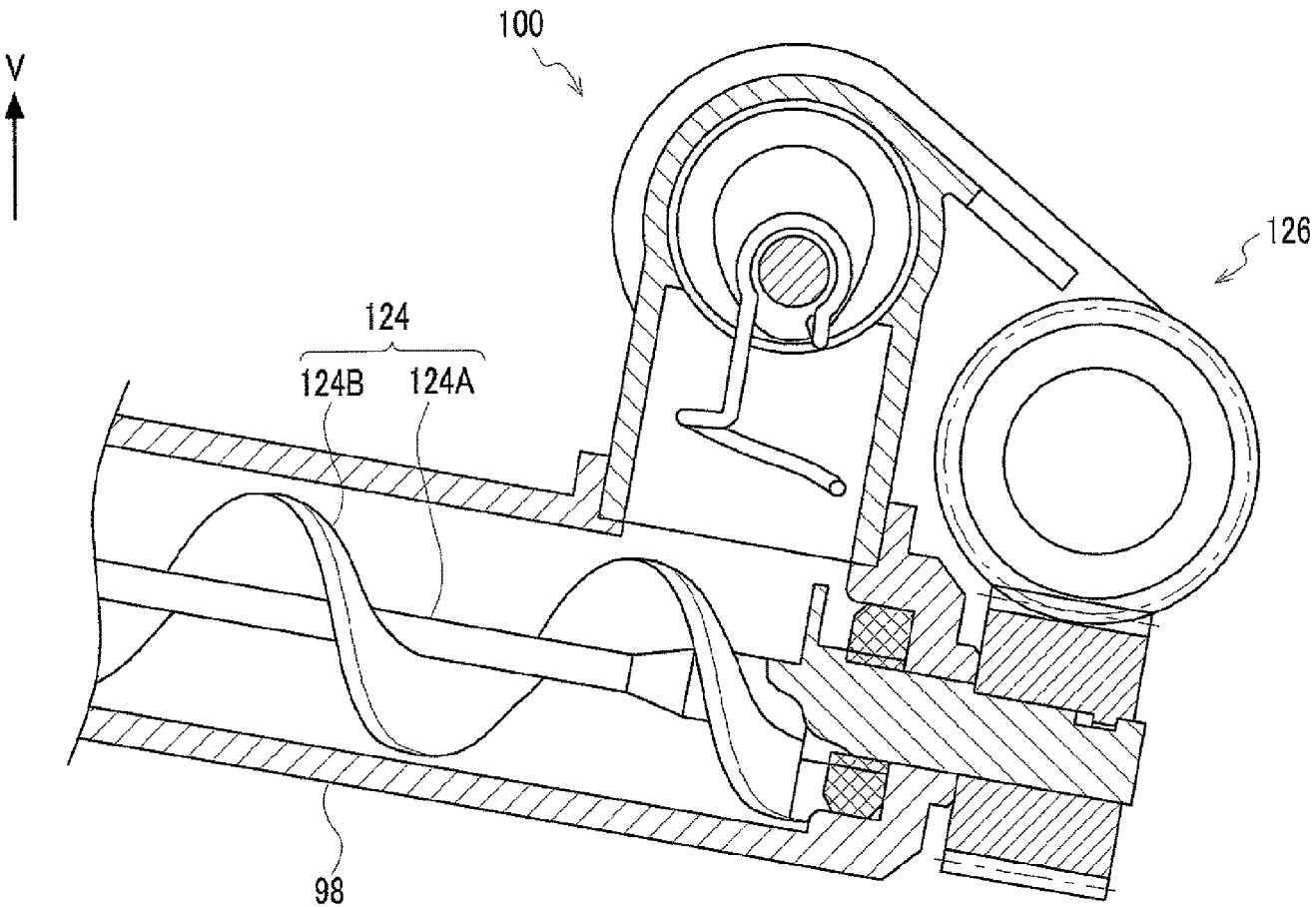
FIG. 7 is a cross-sectional view of an intermediate passage of the toner supply device used in the image forming apparatus according to the exemplary embodiment of the invention.

In addition, as shown in FIGS. 1 and 7, a transport member 124, which transports the toner stored in the body part 96 toward the supply port 110 while rotating and of which the direction of the rotation axis is parallel to the extending direction of the toner transport passage 98, is provided in each toner transport passage 98. The transport member 124 includes a columnar rotating shaft 124A and a blade portion 124B that is formed on the periphery of the rotating shaft 124A, and the toner is transported toward the supply port 110 by the rotation of the blade portion 124B.

Further, the transport member 124 is supported in cantilever state at the base end portion of the toner transport passage 98 (see FIG. 7). Furthermore, the base end portion of the rotating shaft 124A of the transport member 124, which is supported in cantilever state, is connected to a gear group 126 (see FIG. 2) that is provided on the outside of the toner transport passage 98. A driving force from a motor (not shown) is transmitted to the transport member 124 through the gear group 126, so that the transport member 124 is rotated.

In addition, at least a portion of the transport member 124, which is positioned closer to the leading end of the toner transport passage 98 than the rubber tube 122, is made of an elastically deformable resin material.

(Operation of Configuration of Main Parts)

Next, the operations of the image forming units 16, the toner supply device 68, and the like will be described.

As shown in FIG. 6, the toners stored in the body parts of the toner supply devices 68 corresponding to the respective colors are supplied to the developing units 22 through the toner transport passages 98.

Specifically, as shown in FIGS. 2 and 7, the toner stored in the body part 96 enters the base end portion of the toner transport passage 98 through the intermediate passage 100. The toner, which has entered the base end portion of the toner transport passage 98, is transported toward the leading end portion of the toner transport passage 98 by the blade portion 124B of the transport member 124 that is rotated by a driving force transmitted through the gear group 126.

As shown in FIG. 1, the toner, which has been transported toward the leading end portion of the toner transport passage 98, is supplied to the developing unit 22 through the supply port 110 and the receiving port 84 by gravity.

The toner supplied to the developing unit 22 is agitated by the rotating agitating member 80. The toner, which has been agitated by the agitating member 80, is transferred to the rotating developing roller 72.

The rotating developing roller 72 supplies the toner to the image holding body 18 through a gap between itself and the image holding body 18, and develops an electrostatic latent image formed on the outer peripheral surface of the image holding body 18 (visualizes the electrostatic latent image as a toner image).

Here, the developer unit housing 74, which supports the developing roller 72, is rotatably mounted on the image holding body housing 70, which is fixed to the apparatus body 10A, by the shaft member 76. Further, the springs 90 of which one ends are fixed to the developer unit housing 74 urge the roller members 78 so that the roller members 78 come into contact with both end portions of the image holding body 18. Accordingly, the size of the gap (A shown in FIG. 1), which is formed between the developing roller 72 and the image holding body 18 and through which the toner is transferred, is in a predetermined range.

Meanwhile, when the image forming unit 16 is separated from the apparatus body 10A for maintenance or the like, a maintenance door (not shown) provided on the front of the apparatus body lap, is opened first.

Moreover, as shown in FIG. 3, the image forming unit 16 is moved to the front side (the front side of the apparatus body 10A) in the attachment/detachment direction of the image forming unit 16 (which is the depth direction of the apparatus body 10A and is the direction of the arrow D shown in FIG. 3).

When the image forming unit 16 is moved to the front side in the attachment/detachment direction as shown in FIGS. 5A, 5B, and 5C, the shutter 114, which is pressed against the back wall 74A of the developer unit housing 74 and disposed at the open position (see FIG. 5C), is moved to the closed position (see FIG. 5A) by the urging force of the spring 116. Accordingly, the toner, which is supplied to the developing unit 22 from the toner supply device 68, is prevented from being scattered to the outside.

Further, the shutter 86, which is pressed against the side wall 98A of the toner transport passage 98 and disposed at the open position (see FIG. 5C), is moved to the closed position (see FIG. 5A) by the urging force of the springs 88. Accordingly, the toner, which is stored in the developing unit 22, is prevented from being scattered to the outside.

In contrast, when the image forming unit 16 is mounted on the apparatus body 10A after maintenance or the like is finished, the maintenance door (not shown) provided on the front of the apparatus body 10A is opened first.

Moreover, as shown in FIG. 3, the image forming unit 16 is moved to the back side (the back side of the apparatus body 10A) in the attachment/detachment direction of the image forming unit 16 (which is the depth direction of the apparatus body 10A and is the direction of the arrow D shown in FIG. 3).

When the image forming unit 16 is moved to the back side in the attachment/detachment direction as shown in FIGS. 5A, 5B, and 5C, the shutter 114, which is disposed at the closed position (see FIG. 5A) by the urging force of the spring 116, is pressed against the back wall 74A of the developer unit housing 74 and moved to the open position (see FIG. 5C). Further, the protruding portion 92 formed at the developer unit housing 74 comes into contact with the columnar portion 118 formed at the mounting object portion 108 of the toner transport passage 98, so that the developer unit housing 74 is stopped.

Furthermore, the shutter 86, which is disposed at the closed position (see FIG. 5A) by the urging force of the springs 88, is pressed against the side wall 98A of the toner transport passage 98 and moved to the open position (see FIG. 5C).

Here, when the relative position between the receiving port 84 of the developing unit 22 and the supply port 110 of the toner transport passage 98 is deviated as shown in FIG. 1, the rubber tube 122 provided at the toner transport passage 98 is elastically deformed or the entire toner transport passage 98 is rotated about the base end portion of the toner transport passage 98 as a center, so that the deviation of the relative position between the receiving port 84 and the supply port 110 is absorbed.

Further, since only the base end portion of the transport member 124 is supported, the leading end portion of the transport member 124, which is disposed in the toner transport passage 98, is moved together with the toner transport passage 98 as the toner transport passage 98 is moved.

Accordingly, the mounting portion 82 of the developing unit 22 is mounted on the mounting object portion 108 (see FIG. 3) of the toner transport passage 98 as shown in FIG. 1, so that a toner is supplied to the developing unit 22 from the toner supply device 68 through the supply port 110 and the receiving port 84.

As described above, the leading end portion of the toner transport passage 98 extends toward the developing roller 72 and the image holding body 18 when the image forming unit 16 is mounted on the apparatus body 10A. The relative position between the receiving port 84 of the developing unit 22 and the supply port 110 of the toner transport passage 98 is deviated, and the rubber tube 122 may contract in the extending direction of the toner transport passage 98 in order to absorb the deviation of the relative position.

In this case, since the leading end portion of the toner transport passage 98 extends toward the developing roller 72 and the image holding body 18 as described above so that the rubber tube 122 is elastically restored, the roller members 78 are pressed against the image holding body 18 by the force applied to the developing unit 22. For this reason, when the image forming unit 16 is mounted on the apparatus body 10A, the variation of the size of the gap formed between the image holding body 18 and the developing roller 72 is suppressed. In particular, if the intersection between parts is set so that the rubber tube 122 contracts when the above-mentioned relative position is deviated, the configuration is particularly effective in that the variation of the size of the gap is suppressed.

Further, if the structure that suppresses the variation of the size of the gap set between the image holding body 18 and the developing roller 72 is employed, the size of the rubber tube 122 is reduced as compared to the case where this structure is not employed.

Furthermore, according to the above-mentioned exemplary embodiment, each of the toner transport passages 98 is disposed so that the center line J of each toner transport passage 98 passes between the shaft member 76 and the spring 90 when seen in the direction of the rotation axis of the developing roller 72. For this reason, as compared to the case where the center line J of the toner transport passage 98 does not pass between the shaft member 76 and the spring 90, a moment, which causes the developer unit housing 74 to rotate about the shaft member 76 as a center, is reduced by a force that is generated due to the deviation of the relative position between the receiving port 84 and the supply port 110. Accordingly, the variation of the size of the gap formed between the image holding body 18 and the developing roller 72 is effectively suppressed.

Moreover, according to the above-mentioned exemplary embodiment, the straight line G, which connects the rotation axis of the shaft member 76 with the rotating shaft 80A, of the agitating member 80, is parallel to the center line J of each of the toner transport passages 98M, 980, and 98K when seen in the direction of the rotation axis of the developing roller 72. Accordingly, the displacement transmitted to the developer unit housing 74 from the toner transport passage 98 is reduced as compared to the case where the straight line G crosses the center line of each toner transport passage. Therefore, the variation of the size of the gap formed between the image holding body 18 and the developing roller 72 is effectively suppressed.

Further, according to the above-mentioned exemplary embodiment, the transport member 124 is supported in cantilever state at the base end portion of the toner transport passage 98. Accordingly, even though the leading end portion of the toner transport passage 98 is moved due to the deviation of the relative position between the receiving port 84 of the developing unit 22 and the supply port 110 of the toner transport passage 98, the transport member 124 is moved so as to follow the movement of the leading end portion of the toner transport passage 98.

Furthermore, according to the above-mentioned exemplary embodiment, at least a portion of the transport member 124, which is positioned closer to the leading end of the toner transport passage 98 than the rubber tube 122, is made of an elastically deformable resin material. Accordingly, the rubber tube 122 is elastically deformed when the relative position between the receiving port 84 and the supply port 110 is deviated, and the leading end portion of the transport member 124 is elastically deformed even when the portion of the toner transport passage 98, which is positioned closer to the leading end of the toner transport passage 98 than the rubber tube 122, is moved. As a result, the strong friction between the inner wall of the toner transport passage 98 and the transport member 124 is suppressed, so that the generation of a problem such as a mass of a toner (toner grid) is suppressed.

Moreover, according to the above-mentioned exemplary embodiment, as shown in FIG. 3, two springs 88, which urge the shutter 86, are provided so as to urge the both end portions of the shutter 86 in the width direction of the shutter. For this reason, the shutter 86 stably slides as compared to the case where one spring is provided.

Meanwhile, the specific exemplary embodiment of the invention has been described in detail. However, the invention is not limited to the exemplary embodiment of the invention, and it is apparent to those skilled in the art that the invention may have various exemplary embodiments within the scope of the invention. For example, at least a portion of the transport member 124, which is positioned closer to the leading end of the toner transport passage 98 than the rubber tube 122, has been made of an elastically deformable resin material in the above-mentioned exemplary embodiment. However, the diameter of a portion of the shaft member corresponding to the leading end portion of the transport member may be reduced so that the leading end portion of the transport member can be elastically deformed.

Further, the straight line G has been parallel to the center line J of each of the toner transport passages 98M, 980, and 98K in the above-mentioned exemplary embodiment. However, the straight line G may also be parallel to the center line of the toner transport passage 98Y. Furthermore, a toner has been supplied to the developing unit 22 in the exemplary embodiment of the invention. However, a developer, which is a mixture of a toner and a carrier, may be supplied to the developing unit. Moreover, an electrophotographic image forming apparatus has been described in the exemplary embodiment of the invention, but the invention may also be applied to image forming apparatuses using other developers such as an inkjet image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

image forming units that are detachably mounted on an apparatus body, each of the image forming units including an image holding body where an electrostatic latent image is formed on a surface of the image holding body and a developing unit provided with a developing member that is disposed with a gap between the developing member and the image holding body and supplies a developer to the electrostatic latent image formed on the surface of the image holding body while rotating;

shaft members that are provided at the image forming units and rotatably support the developing units so that the developing members approach or are separated from the image holding bodies when seen in a direction of a rotation axis of the developing member, a direction of a rotation axis of each shaft member being parallel to the rotation axis of the developing member;

urging members that are provided at the image forming units and urge the developing members toward the image holding bodies, one end of each of the urging members being fixed to each of the developing units;

supply devices that are disposed adjacent to the developing units and supply developers to the developing units when seen in the direction of the rotation axis of the developing member;

transport passages of which base end portions are connected to body parts of the supply devices, through which developers stored in the body parts are transported to the developing units, and which are provided so as to extend toward the developing members and the image holding bodies when seen in the direction of the rotation axis of the developing member, the developers being transported to the developing units from supply ports formed at leading end portions of the transport passages through receiving ports of the developing units connected to the supply ports; and elastic members each of which forms a part of the transport passage and is extensibly deformed so as to absorb the deviation of the relative position between the supply port and the receiving port.

2. The image forming apparatus according to claim 1, wherein the transport passages are disposed so that a center line of the transport passage, which extends in an extending direction of the transport passage, passes between the shaft member and the urging member when seen in the direction of the rotation axis of the developing member.

3. The image forming apparatus according to claim 2, further comprising:

agitating members that are provided at the developing units and agitate the developers supplied from the receiving ports while rotating, a direction of a rotation axis of each of the agitating members being parallel to the direction of the rotation axis of the developing member, wherein the transport passages extend along a straight line that connects the rotation axis of each shaft member with the rotation axis of each of the agitating members when seen in the direction of the rotation axis of the developing member.

4. The image forming apparatus according to claim 3, wherein each of the transport passages has a tubular shape, and a transport member, which transports the developer stored in the body part toward the supply port while rotating and is supported in cantilever state at a base end portion of the transport passage and of which the direction of the rotation axis is parallel to an extending direction of the transport passage, is disposed in each of the transport passages.

5. The image forming apparatus according to claim 4, wherein a portion of the transport member, which is positioned closer to a leading end portion of the transport passage than the elastic member, is elastically deformed.

6. The image forming apparatus according to claim 2, wherein each of the transport passages has a tubular shape, and a transport member, which transports the developer stored in the body part toward the supply port while rotating and is supported in cantilever state at a base end portion of the transport passage and of which the direction of the rotation axis is parallel to an extending direction of the transport passage, is disposed in each of the transport passages.

7. The image forming apparatus according to claim 6, wherein a portion of the transport member, which is positioned closer to a leading end portion of the transport passage than the elastic member, is elastically deformed.

8. The image forming apparatus according to claim 1, further comprising:

agitating members that are provided at the developing units and agitate the developers supplied from the receiving ports while rotating, a direction of a rotation axis of each of the agitating members being parallel to the direction of the rotation axis of the developing member, wherein the transport passages extend along a straight line that connects the rotation axis of each shaft member with the rotation axis of each of the agitating members when seen in the direction of the rotation axis of the developing member.

9. The image forming apparatus according to claim 8, wherein each of the transport passages has a tubular shape, and a transport member, which transports the developer stored in the body part toward the supply port while rotating and is supported in cantilever state at a base end portion of the transport passage and of which the direction of the rotation axis is parallel to an extending direction of the transport passage, is disposed in each of the transport passages.

10. The image forming apparatus according to claim 9, wherein a portion of the transport member, which is positioned closer to a leading end portion of the transport passage than the elastic member, is elastically deformed.

11. The image forming apparatus according to claim 1, wherein each of the transport passages has a tubular shape, and a transport member, which transports the developer stored in the body part toward the supply port while rotating and is supported in cantilever state at a base end portion of the transport passage and of which the direction of the rotation axis is parallel to an extending direction of the transport passage, is disposed in each of the transport passages.

12. The image forming apparatus according to claim 11, wherein a portion of the transport member, which is positioned closer to a leading end portion of the transport passage than the elastic member, is elastically deformed.

* * * * *